US008282516B2

(12) United States Patent
Chauvin et al.

(10) Patent No.: US 8,282,516 B2
(45) Date of Patent: Oct. 9, 2012

(54) BALL BAT INCLUDING A TAMPER-RESISTANT CAP

(75) Inventors: Dewey Chauvin, Simi Valley, CA (US); H. Y. Chuang, Simi Valley, CA (US)

(73) Assignee: Easton Sports, Inc., Van Nuys, CA (US)

( * ) Notice: Subject to any disclaimer, the term of this patent is extended or adjusted under 35 U.S.C. 154(b) by 210 days.

(21) Appl. No.: 12/893,840

(22) Filed: Sep. 29, 2010

(65) Prior Publication Data

US 2011/0077111 A1 Mar. 31, 2011

Related U.S. Application Data

(63) Continuation-in-part of application No. 12/259,087, filed on Oct. 27, 2008, now Pat. No. 7,914,404.

(51) Int. Cl.
*A63B 59/06* (2006.01)

(52) U.S. Cl. ..... 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,237,946 | A | 3/1966 | Velkas | |
| 3,380,305 | A | 4/1968 | Charell | |
| 3,830,496 | A | 8/1974 | Reizer | |
| 4,526,752 | A | 7/1985 | Perlman et al. | |
| 5,119,964 | A | 6/1992 | Witt | |
| 5,217,307 | A * | 6/1993 | McClintock | 383/81 |
| 5,303,917 | A | 4/1994 | Uke | |
| 5,397,636 | A | 3/1995 | Miyao et al. | |
| 5,415,398 | A | 5/1995 | Eggiman | |
| 5,421,572 | A * | 6/1995 | MacKay, Jr. | 473/566 |
| 5,452,889 | A * | 9/1995 | Lewinski et al. | 473/519 |
| 5,490,669 | A * | 2/1996 | Smart | 473/564 |
| 5,676,610 | A | 10/1997 | Bhatt | |
| 5,837,341 | A | 11/1998 | Johnstone | |
| 6,053,828 | A | 4/2000 | Pitsenberger | |
| 6,082,568 | A | 7/2000 | Flanagan | |
| 6,085,903 | A | 7/2000 | Jotcham | |
| 6,276,725 | B1 * | 8/2001 | Laurash et al. | 283/81 |
| 6,352,485 | B1 * | 3/2002 | Philpot et al. | 473/564 |
| 6,436,483 | B2 | 8/2002 | Palmasi et al. | |
| 7,171,999 | B2 * | 2/2007 | Cirone | 150/154 |
| 7,207,907 | B2 | 4/2007 | Guenther et al. | |
| 7,232,387 | B1 | 6/2007 | Heald et al. | |
| 7,383,999 | B2 | 6/2008 | Bi | |
| 7,534,180 | B1 | 5/2009 | Vacek et al. | |
| 7,857,719 | B2 | 12/2010 | Giannetti et al. | |
| 7,914,404 | B2 | 3/2011 | Giannetti et al. | |
| 8,062,154 | B2 | 11/2011 | Burger | |

(Continued)

OTHER PUBLICATIONS

Mustone et al., Timothy J., "Using LS-DYNA to develop a baseball bat performance and design tool," 6th International LS-DYNA Users Conference, Apr. 9-10, 2000.

(Continued)

*Primary Examiner* — Mark Graham
(74) *Attorney, Agent, or Firm* — Perkins Coie LLP

(57) ABSTRACT

A ball bat includes a transparent or translucent cap attached to a bat barrel. One or more security labels are bonded or otherwise attached to the cap and the barrel such that removal of the cap damages or destroys the one or more security labels, providing an indication that the cap has been removed and that tampering with the interior of the bat may have occurred.

15 Claims, 7 Drawing Sheets

U.S. PATENT DOCUMENTS

| | | | | |
|---|---|---|---|---|
| 2004/0209716 | A1 | 10/2004 | Vacek et al. | |
| 2004/0224803 | A1 | 11/2004 | Forsythe et al. | |
| 2005/0176531 | A1 | 8/2005 | Fitzgerald et al. | |
| 2005/0230960 | A1* | 10/2005 | Bilodeau et al. | 283/75 |
| 2005/0237205 | A1 | 10/2005 | Gorst | |
| 2005/0247764 | A1 | 11/2005 | Sierra-Gomez et al. | |
| 2006/0229147 | A1* | 10/2006 | Nusbaum et al. | 473/457 |
| 2006/0232057 | A1 | 10/2006 | Dome | |
| 2006/0276275 | A1* | 12/2006 | Guenther et al. | 473/564 |
| 2007/0042844 | A1 | 2/2007 | Stote et al. | |
| 2008/0058132 | A1* | 3/2008 | Nguyen | 473/564 |
| 2010/0105504 | A1 | 4/2010 | Giannetti | |

OTHER PUBLICATIONS

USPTO, International Search Report and Written Opinion for PCT/US2009/059204, mailed Nov. 25, 2009.

United States Patent and Trademark Office, International Search Report and Written Opinion for PCT/US11/52825, Feb. 22, 2012.

* cited by examiner

FIG. 4
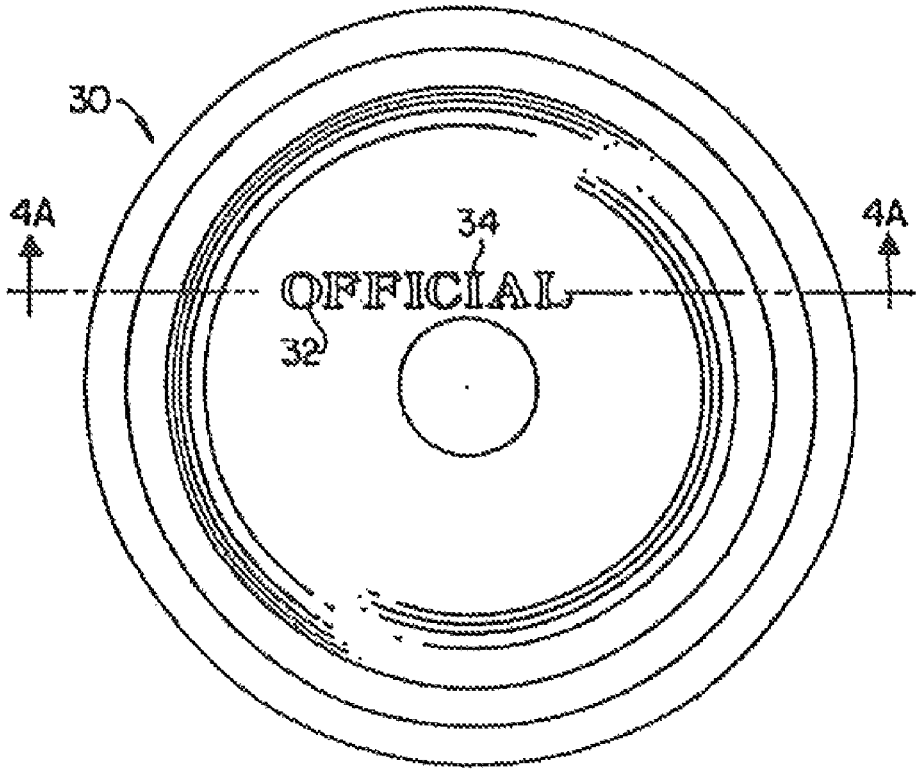
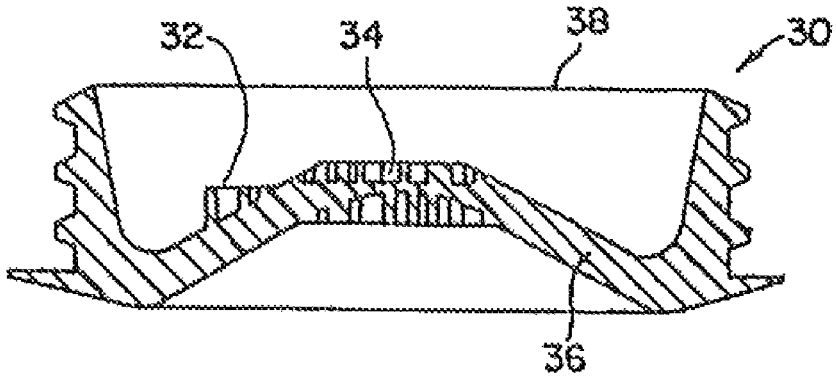
FIG. 4A

BALL BAT INCLUDING A TAMPER-RESISTANT CAP

PRIORITY CLAIM

This application is a Continuation-in-Part of U.S. patent application Ser. No. 12/259,087, filed Oct. 27, 2008 now U.S. Pat. No. 7,914,404, which is incorporated herein by reference.

BACKGROUND

One area of concern in the ball bat industry is the purposeful tampering with, or "doctoring" of, the barrel structure by players. Doctoring typically refers to a method by which a player structurally alters a ball bat, such as a composite or aluminum bat, in a manner that increases the bat's performance, often beyond the limits of association-approved play. One common method of doctoring includes removing, via sanding or shaving, internal layers of the bat barrel. Doing so reduces the barrel's thickness, which lessens the weight of the bat and increases the radial compliance of the barrel. This increase in radial barrel compliance generally leads to an increase in the velocity of a batted ball, often beyond approved association limits. Unfortunately, it is typically very difficult to detect such internal doctoring.

SUMMARY

A ball bat includes a transparent or translucent cap attached to a bat barrel. One or more security labels are bonded or otherwise attached to the cap and the barrel such that removal of the cap damages or destroys the one or more security labels. Other features and advantages will appear hereinafter. The features described above can be used alone or in various combinations with one another.

BRIEF DESCRIPTION OF THE DRAWINGS

In the drawings, wherein the same reference number indicates the same element throughout each of the views:

FIG. 4 is a top-perspective view of a tamper-resistant cap, according to one embodiment.

FIG. 4A is a side-sectional view, taken along line A-A, of the tamper-resistant cap shown in FIG. 4.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description and claims presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
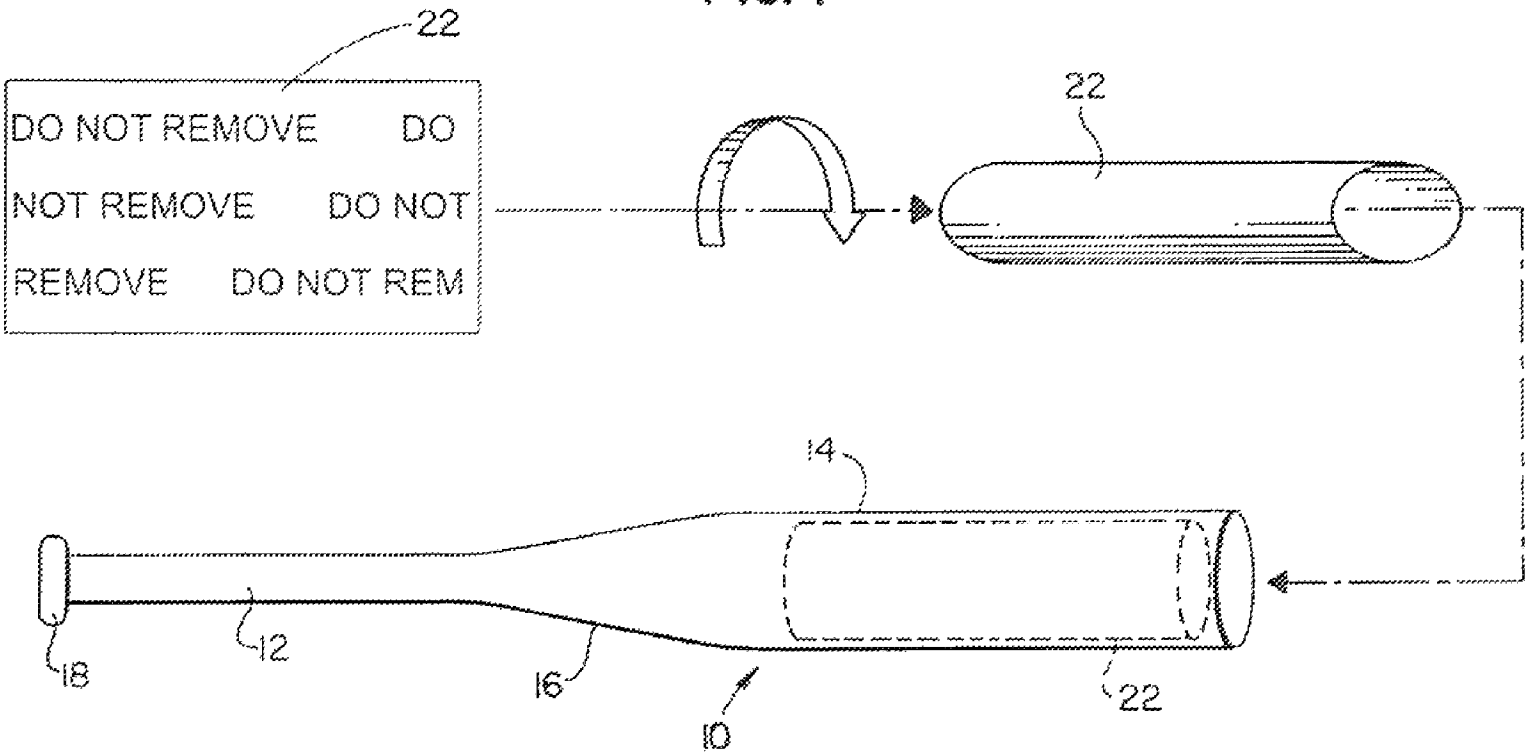
FIG. 1 is a schematic view of a ball bat showing a tamper-indicating layer located in the barrel of the ball bat, according to one embodiment.
Figure 3:
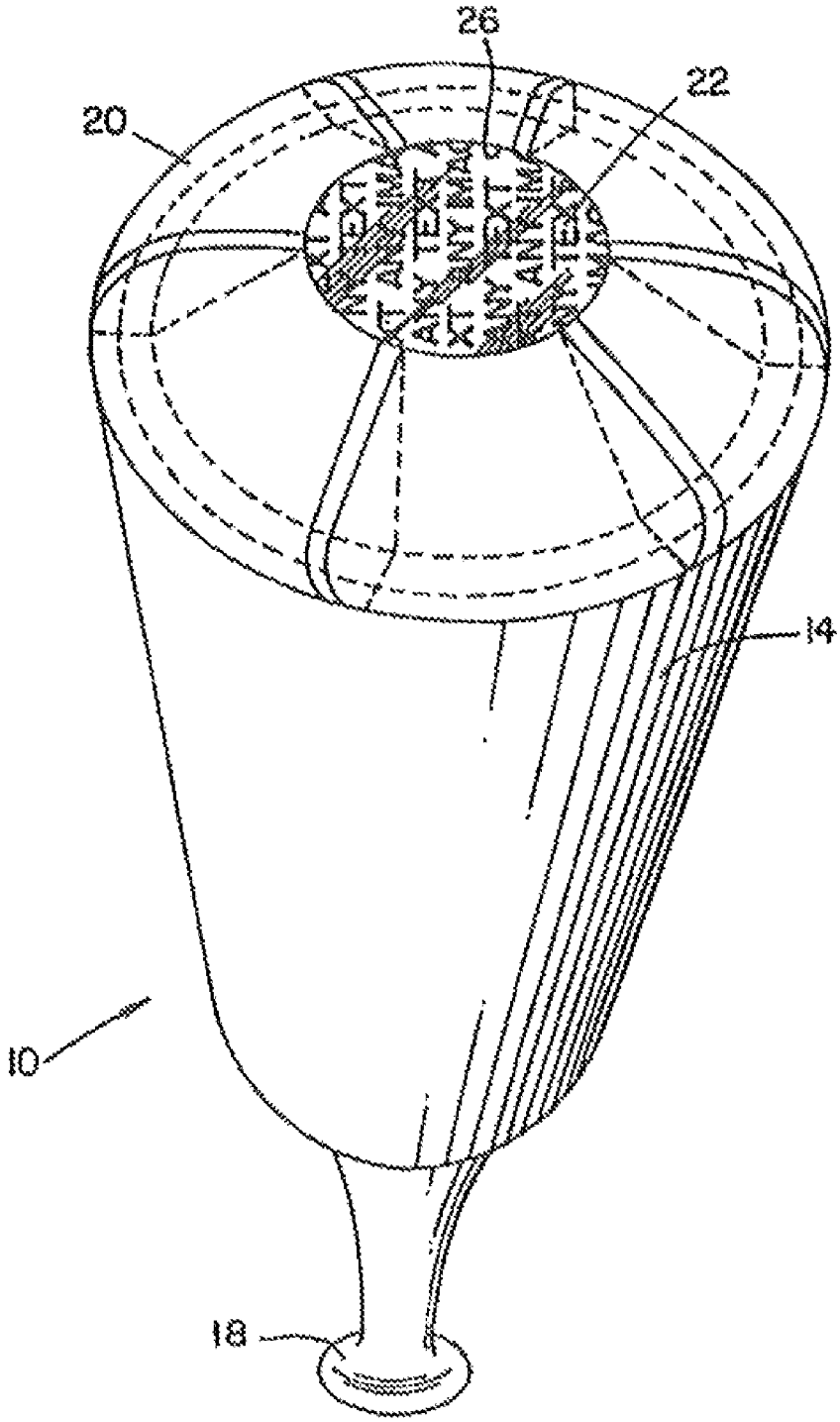
FIG. 3 is perspective view of a ball bat including a cap with a window for providing visual inspection of a tamper-indicating layer in the ball bat, according to one embodiment.

Turning in detail to the drawings, as shown in FIG. 1, a baseball or softball bat 10, hereinafter collectively referred to as a "ball bat" or "bat," includes a handle 12, a barrel 14, and a tapered section 16 joining the handle 12 to the barrel 14. The handle 12 and barrel 14 may be separate pieces or may be integrally joined to each other via the tapered section 16. The free end of the handle 12 includes a knob 18 or a similar structure. The barrel 14 is preferably closed off by a suitable cap 20 or plug, as shown in FIG. 3, for example. The interior of the bat 10 is hollow, which allows the bat 10 to be relatively lightweight so that ball players may generate substantial bat speed when swinging the bat 10.

The ball bat 10 preferably has an overall length of 20 to 40 inches, more preferably 26 to 34 inches. The overall barrel diameter is preferably 2.0 to 3.0 inches, more preferably 2.25 to 2.75 inches. Typical ball bats have diameters of 2.25, 2.625, or 2.75 inches. Bats having various combinations of these overall lengths and barrel diameters, as well as any other suitable dimensions, are contemplated herein. The specific preferred combination of bat dimensions is generally dictated by the user of the bat 10, and may vary greatly between users.

The ball bat 10 is preferably constructed from one or more composite or metallic materials. Some examples of suitable composite materials include fiber-reinforced glass, graphite, boron, carbon, aramid, ceramic, Kevlar, or Astroquartz®. Aluminum or another suitable metallic material may also be used to construct the ball bat 10. A ball bat including a combination of metallic and composite materials may also be constructed. For example, a ball bat having a metal barrel and a composite handle, or a composite barrel and a metal handle, may be used in the embodiments described herein. Additionally, the ball bat 10 may include a single-wall or multi-wall barrel, as described in detail in U.S. Pat. No. 7,115,054, for example, which is incorporated herein by reference.

As schematically shown in FIG. 1, an indicator layer 22 including graphics is affixed to, or integral with, a radially inner surface of the barrel 14. The graphics on the indicator layer 22 may include words, numbers, colors or any other visual elements that differ in appearance from the radially inner surface of the barrel 14 itself. As a result, removal of a portion of the indicator layer 22 provides a visual indication that tampering with the indicator layer 22, and most likely with the radially inner surface of the barrel 14, has occurred. If a user shaves or sands away radially inner regions of the barrel 14, for example, portions of the indicator layer 22 that previously covered those regions of the barrel 14 will be shaved away, as well. As a result, a person viewing the radially inner surface of the barrel 14 will readily be able to observe that portions of the indicator layer 22, and most likely portions of the barrel 14, have been removed.

Figure 2:
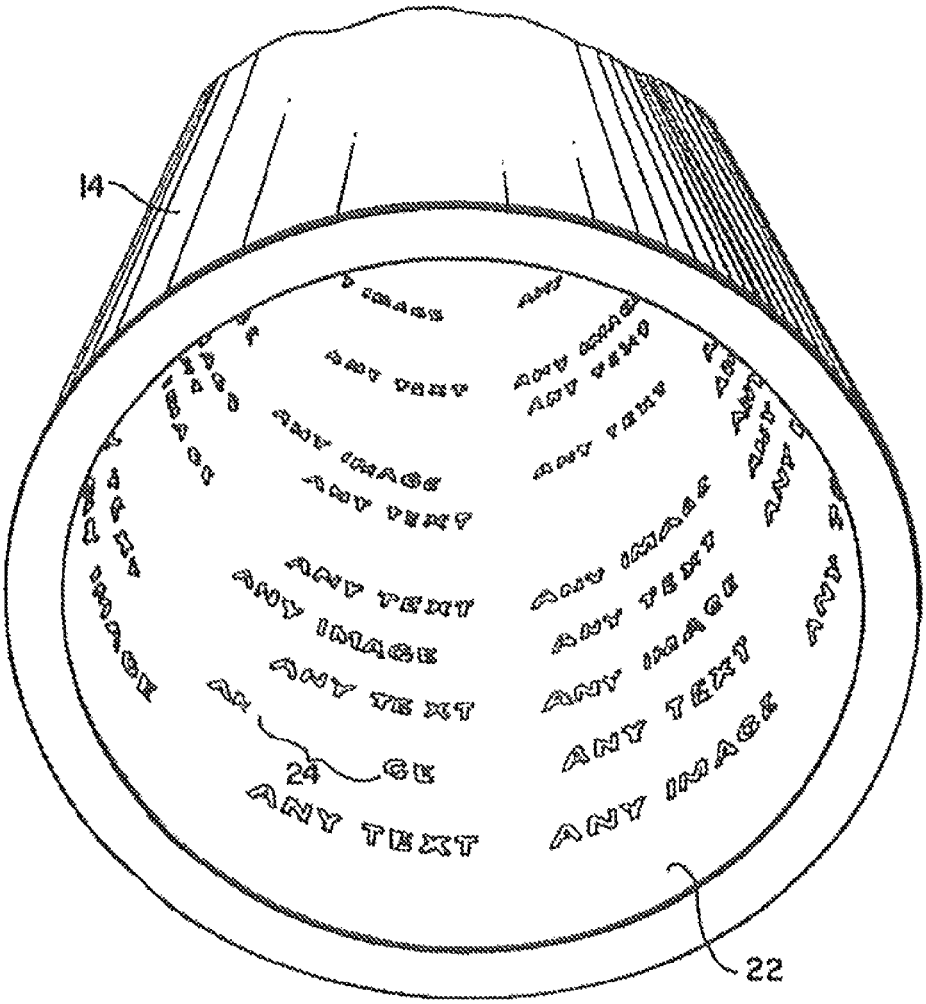
FIG. 2 is a partial top-perspective view of a ball bat with the cap removed to reveal an indicator layer to which discrete tampering has occurred, according to one embodiment.

An example of such tampering is shown in FIG. 2, in which a discrete portion 24 of an instance of the term "Any Image" has been removed from the indicator layer 22 in a bat 10 from which the cap has been removed. As is clear in FIG. 2, a viewer can readily observe that tampering with the indicator layer 22, and most likely with the radially inner surface of the barrel 14, has occurred, due to the absence of the portion 24 of the term "Any Image" from the indicator layer 22.

While a user who shaves or sands the radially inner surface of a bat barrel 14 to gain a performance advantage would typically remove a much greater portion of the inner surface of the barrel 14 than that which is shown in FIG. 2, it is preferable that the words or other graphics on the indicator layer 22 are located in close proximity to one another so that they occupy most of the surface area of the indicator layer 22. Words such as "Do Not Remove," "Do Not Disturb," or "Official," for example, may be repeatedly printed on the indicator layer 22 in close proximity to one another to provide an indication of tampering at almost any region of the indicator layer 22. Accordingly, a user cannot easily shave or sand away barrel regions located between the words or graphics. Any suitable text or image could be used for this purpose.

Alternatively (or additionally), the entire indicator layer 22 may be dyed or otherwise colored in one or more hues that differ, preferably substantially, from the color of the radially inner surface of the bat barrel 14. In this scenario, removal of any portion of the indicator layer 22 would be readily observable by a viewer, due to the stark contrast between the colors of the indicator layer 22 and the radially inner surface of the bat barrel 14.

In one embodiment of a composite ball bat 10, the indicator layer 22 is made from a porous, printable material that may be co-molded with the composite layers of the bat barrel 14. In this embodiment, the indicator layer 22 becomes integral with the barrel structure after molding of the ball bat 10. The porous, printable material may optionally be made of the same fiber-reinforced, composite materials used to construct the ball bat 10 such that the indicator layer 22 becomes substantially or completely homogeneous with the composite barrel 14 after the molding process. The indicator layer 22 may, for example, be a ply of fiberglass or of another fiber-reinforced material with graphics or colors applied thereon. The indicator layer 22 may alternatively be a spunbond nylon, nonwoven material, or any other material suitable for displaying words or other graphics over the radially inner surface of the bat barrel 14.

The indicator layer 22 may alternatively be affixed or otherwise attached to the radially inner surface of the bat barrel 14 after the bat has been molded or formed. A sheet or sleeve of plastic, nylon, paper, or another suitable material, including printed or otherwise applied graphics, may be adhered with a strong epoxy, or otherwise affixed, to the radially inner surface of the bat barrel 14. If epoxy or glue is used to affix the indicator sheet or sleeve to the barrel 14, it is preferably applied over substantially the entire surface area of the sheet or sleeve to form a strong, complete bond between the sheet or sleeve and the inner barrel surface. Accordingly, a player would be effectively prevented from removing the sheet or sleeve from the barrel 14, then shaving or sanding away portions of the barrel 14, then replacing the sheet or sleeve over the shaved or sanded regions to hide those regions.

In an alternative embodiment, the indicator words or other graphics may be directly painted on or otherwise applied to the radially inner surface of the bat barrel 14, as opposed to being embodied in or on a separate layer of material. For example, the radially inner surface of the barrel 14 may be painted or dyed one or more colors different from that of the barrel material itself. Alternatively, "non-barrel colored" words or other graphics may be written, painted, or otherwise applied to the radially inner surface of the barrel 14. For example, the instances of "Any Text" and "Any Image" shown in FIG. 2 may be embodied in a separate indicator layer 22, as described above, or may be painted on or otherwise directly applied to the radially inner surface of the bat barrel 14.

As shown in FIG. 3, in one embodiment, the ball bat 10 includes a cap 20 that allows for visual inspection of the indicator layer 22 (or directly applied graphics) by a viewer without requiring removal of the cap 20. In one embodiment, all or some of the cap 20 itself is transparent or translucent so that a user can view the indicator layer 22 through the cap 20. In another embodiment, the cap may include an opening 26 through which the indicator layer 22 may be viewed. A plastic window or other transparent or translucent element is preferably positioned in, or otherwise covers, the opening 26 to prevent dust or debris from entering the interior of the ball bat 10.

Additionally or alternatively, the cap 20 may be readily removable so that an umpire or other game official, for example, may quickly remove the cap 20 to inspect the integrity of the indicator layer 22 or directly applied graphics. Such a cap 20 may include threads that are threadable into corresponding threads in the free end of the barrel 14, or may be configured to be snap-fit into a receiving element molded into the barrel 14, or may be removably attached via any other suitable mechanism.

In one embodiment, an indicator layer or directly applied graphics may additionally or alternatively be included on a radially inner surface of the handle 12 of the ball bat 10. In this scenario, the knob 18 may be transparent or translucent, or may include a window, as described above with respect to the cap 20, to provide visual inspection of the indicator layer or directly applied graphics in the handle 12. Alternatively or additionally, the knob may be readily removable, and may be attached in any suitable manner, such as via the mechanisms described above with respect to the cap 20, to allow for visual inspection of the indicator layer or directly applied graphics in the handle 12.

Turning to FIGS. 4 and 4A, in another embodiment, a transparent or translucent cap 30 includes internal observable features, such as raised or embossed letters 32 or recessed letters 34, on or in an inner section 36 of the cap 30. In the embodiment shown in FIG. 4, the letters of the word "Official" are embossed on and engraved into the upper and lower surfaces of the inner section 36 of the cap 30. The observable features may alternatively include any texture, text, or image embossed on or engraved into the upper or lower surfaces of the inner section 36 such that they are visible when the cap 30 is installed in the bat 10.

While the observable features may be located on or in only one of the upper and lower surfaces of the inner section 36, it is preferable to locate the observable features on or in both the upper and lower surfaces, since such a configuration is more difficult to replicate or counterfeit. When the observable features are positioned in this manner, an observer will see the upper and lower features separate and then align as the viewing angle changes.

Barrel caps are often loaded with material to add weight to the end of the bat to provide a desired moment of inertia (swing weight) for a given bat model. This end load material is typically an epoxy or urethane that is poured into the cap or bat and allowed to cure in place. The end load material may be opaque or, if translucent, may have a different index of refraction than that of the transparent or translucent cap 30, thereby allowing a viewer to readily see the observable features on or in the inner section 36 of the cap 30.

In a preferred embodiment, the observable features are of a nature that is very difficult to replicate. The observable features could, for example, include very fine details, such as fine gratings or images. Text that is both engraved and embossed would also be difficult to replicate. Micro or nano-text letters, or images smaller than 0.020" high, for example, may also be combined into macro-scale text or images. Micro or nano-text would be very difficult to replicate. Its presence, therefore, suggests that an image is authentic.

The ability to achieve these micro and nano features is a function of the methods used to mold (typically injection molding) the original bat caps and the melt viscosity of the material used to mold the cap. Typical materials used to mold caps, for example, polycarbonate, lexan, urethane, and nylon, can include molded features that are 0.003 inches or smaller. Casting features this small can be difficult due to the relatively high viscosity of the material and the low pressure at which the molding process occurs. Accordingly, replicating or counterfeiting caps made according to these methods, without bubble entrapment in the translucent material, is much more difficult to achieve than are current methods of making counterfeit caps in an opaque material. Indeed, casting a counterfeit cap in a transparent or translucent material, in general, is very challenging. Casting flaws, such as bubbles, striations, and sink marks, are likely to occur. Such flaws are readily observable indicators that a cap may not be a manufacturer's original cap.

The translucent or transparent cap 30 may alternatively include a security feature or image molded within the cap 30 between the inner section 36 and the outer section 38. A label, decal, medallion, fibers, netting, or graphic image, for example, may be injection molded within the walls of the translucent cap 30. A cap including such a security feature would be very difficult to replicate or counterfeit. Placement of a security hologram within the walls of the cap is also possible, though the three-dimensional effect of the hologram could be diminished due to the optical index of refraction of the cap material, which could alter the virtual position of the image.

To make counterfeiting of the cap 30 even more difficult, the translucent cap 30 may include alternating materials or colors. Mixing materials or textures, especially hard and soft textures, for example, would make counterfeiting very difficult.

Figure 5:
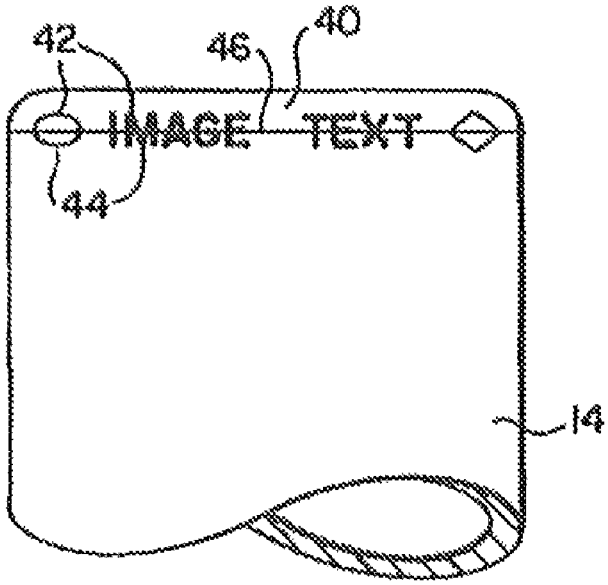
FIG. 5 is a partial-side view of bat barrel including an engraved or etched cap.
Figure 5A:
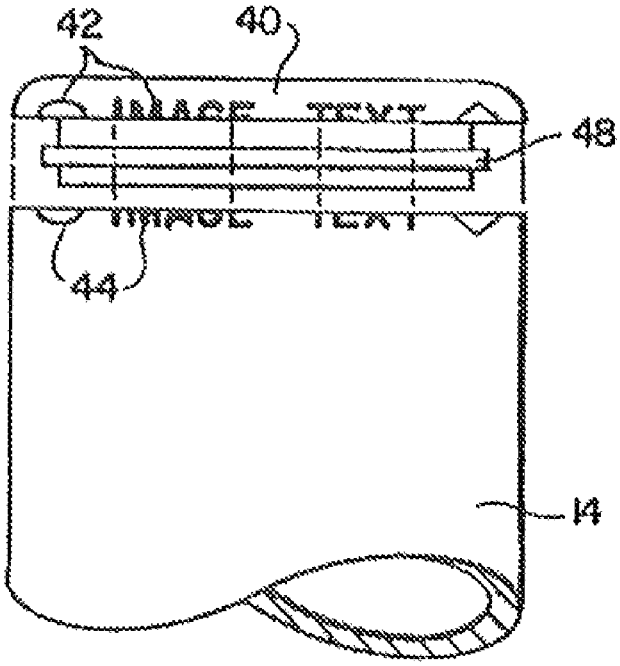
FIG. 5A is a partial-side exploded view of the bat barrel and engraved or etched cap shown in FIG. 5.

Turning to FIGS. 5 and 5A, in another embodiment, a cap 40 including engraved or etched portions 42 is attached to the bat barrel 14. The barrel 14 includes complementary or corresponding engraved or etched portions 44. The engraving or etching is preferably performed after the cap 40 is attached to the barrel 14 to assure proper alignment of the image details between the barrel 14 and the cap 40. The fine detail in the image or text traversing the seam or parting line 46 between the cap 40 and the barrel 14 makes it very difficult for someone to remove the cap 40 from the barrel 14 without disturbing the alignment of the image or text. Thus, a misalignment in the image or text is an indication that the bat 10 may have been tampered with or modified. In a preferred embodiment, an attachment portion 48 of the cap 40 is adhesively bonded to a receiving element inside the barrel 14, or directly to the radially inner surface of the barrel 14, to prevent possible rotation or axial movement of the cap 40 during normal use.

The engraved or etched cap 40 may be transparent, translucent, or opaque. The cap 40 may be made of any suitable material, such as a thermoplastic or thermoset material. Some examples of suitable cap materials are urethane, acrylic, ABS, polycarbonate, PVC, nylon, or alloys of these materials.

The engraving or etching may be performed using one or more lasers, a machined engraving pen, a stylus, a chemical etchant, a sand blaster with a stencil that includes bead blasting, or another suitable device. The engraving or etching is preferably sufficiently deep that normal wear and tear will not remove the engraved or etched image. While the necessary depth may vary based on the specific materials used in the cap 40 and the barrel 14, a depth of at least 0.005 inches is generally preferred.

The engraved regions may optionally be filled with a contrastingly colored resin or similar material for aesthetic purposes or to reduce wear. Filling the engraved regions with a contrasting color material would also make it more difficult for a counterfeiter to cast a mold to replicate the engraving.

Any of the tamper-indicating caps 30 or 40 described above are preferably made of a substantially rigid or brittle material, such as a polycarbon or other high modulus material, such that it is difficult to remove the cap 30 or 40 without damaging or breaking the cap 30 or 40. The caps 30 or 40 are preferably attached to the barrel 14 via a snap-fit or an adhesive, such as a strong epoxy. Thus, if a player removes the rigid or brittle cap (with the intention of shaving or sanding the internal barrel surface, for example), the cap 30 or 40 will crack or break, and the player will not be able to effectively replace the cap in the barrel 14. Furthermore, because the observable or etched features of the cap 30 or 40 are difficult to replicate or counterfeit, the player will likely not be able to attain a suitable counterfeit cap to replace the original cap 30 or 40. Accordingly, the presence of an unoriginal or "unofficial" cap in a bat barrel 14 will provide evidence that tampering with the inner surface of the barrel 14 may have occurred.

Figure 6:
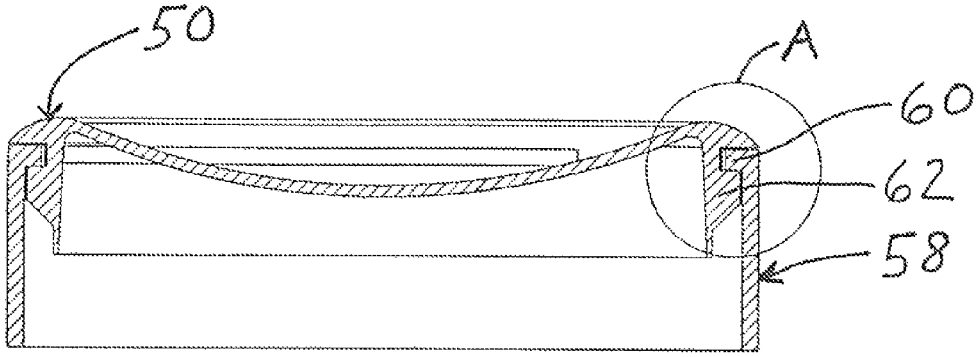
FIG. 6 is a sectional view of an alternative tamper-resistant cap attached to a bat barrel, according to one embodiment.
Figure 6A:
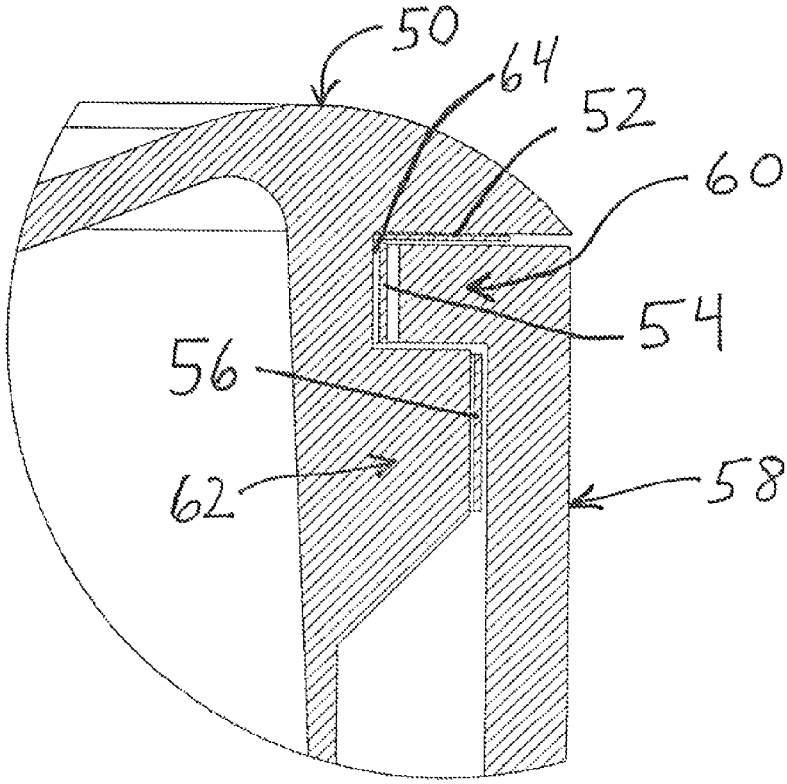
FIG. 6A is a magnified view of Section A of FIG. 6 indicating three possible security label locations.

FIGS. 6 and 6A illustrate another embodiment of a ball bat including a tamper-resistant cap 50. The cap 50 is preferably transparent or translucent such that one or more security labels 52, 54, 56, which are attached to the bat barrel 58 and the cap 50, may be viewed through the cap 50. For ease of description, the uppermost security label 52 shown in FIG. 6A will generally be referred to herein but it is to be understood that one or more security labels, such as the labels 52, 54, 56 shown in FIG. 6A, may be attached to the barrel 58 and the cap 50 of a given bat.

The security label 52 is preferably tamper-resistant such that it cannot readily be transferred from one product to another without sustaining significant damage. Some examples of tamper-resistant labels are automobile registration stickers adhered to state license plates, and warranty seals bonded across seams of products to prevent tampering of internal objects or devices. These labels are generally severely damaged or destroyed upon removal from the surface to which they were originally adhered. Thus, a damaged or destroyed security label 52 provides an indication that the cap 50 has been removed and that tampering with the interior of the bat may have occurred.

For additional protection against counterfeiting, the security label 52 optionally includes a secure label image that is difficult to copy or counterfeit. For example, the security label 52 may include a holographic image, or may include a custom image made from a reflective ink or a wavelength-specific ink that is not readily available or easily duplicated using a standard laser printer or other common printing machine. Additionally or alternatively, the security label 52 may be cut into an intricate shape to make counterfeiting the label more difficult.

The security label 52 is preferably bonded to the cap 50 via a transparent or translucent adhesive such that the label 52 may be viewed through the cap 50 while the cap is attached to the bat barrel 58. The other surface of the security label 52 may be bonded to a surface of the barrel 58 via the same or a different adhesive.

As illustrated in FIGS. 6 and 6A, the barrel 58 may optionally include an inwardly projecting cap retention lip or arm 60 over which the cap 50 may be snap-fit or otherwise suitably secured. The retention arm 60 retains the cap 50 in place, while also providing multiple surfaces to which one or more security labels may be bonded. To secure the cap 50 to the barrel 58, a lower region 62 of the cap 50 is squeezed or flexed radially inwardly and pushed beyond the retention arm 60, after which the lower region 62 flexes radially outwardly to snap into place behind the retention arm 60.

In one embodiment, the security label 52 is bonded to the cap 50 before inserting the cap 50 into the barrel 58. Adhesive is also applied to the opposite surface of the security label 52 (or to the inner surface of the barrel where the label will be located) before insertion of the cap 50 such that the security label 52 bonds to the barrel 58 (or the retention arm 60 of the barrel) when the cap 50 is snapped into place.

Alternatively, the security label 52 could be bonded to the barrel 58 before insertion of the cap 50. Adhesive may be applied to the opposite surface of the security label 52 (or to the cap 50 portion that will come into contact with the label 52), after which the cap may be inserted into place and bonded to the security label 52. A thicker layer of adhesive between the cap 50 and the security label 52 may be required in this embodiment to prevent damage to the label 52 as the cap 50 is inserted past the label 52 into the barrel 58 (see, for example, the layer of adhesive 64 between security label 54 and the cap 50).

In another embodiment, the cap may be threaded into the barrel and may include a lower region below the threads to which a security label may be bonded. Adhesive may be applied to the barrel at the location where the lower cap region will contact the barrel, or to the lower cap region itself, such that the cap will bond to the security label after the cap is threaded into the barrel. Any other suitable cap retention configuration or device may alternatively be used, as long as the security label 52 is bonded to both the barrel 58 and the cap 50.

Figure 7:
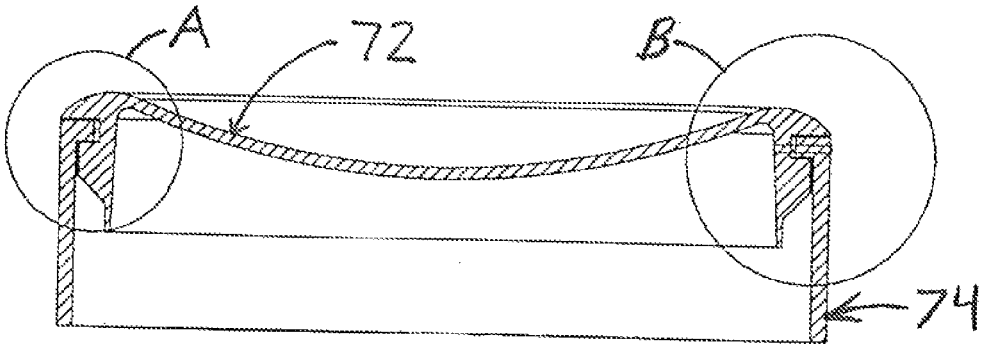
FIG. 7 is a sectional view of another alternative tamper-resistant cap attached to a bat barrel, according to one embodiment.
Figure 7A:
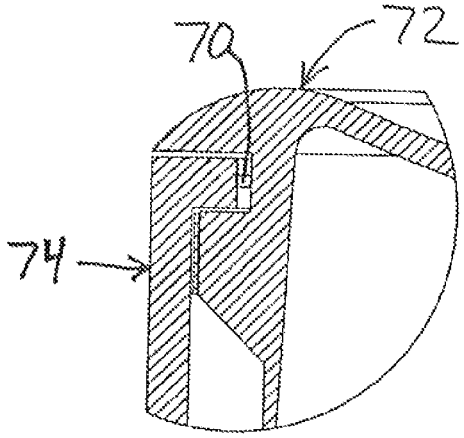
FIG. 7A a magnified view of Section A of FIG. 7 indicating one possible security thread location.
Figure 7B:
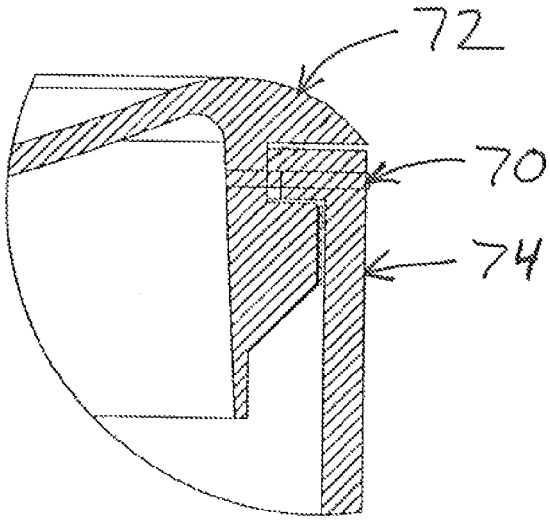
FIG. 7B a magnified view of Section B of FIG. 7 indicating another possible security thread location.

As shown in FIGS. 7, 7A, and 7B, in other embodiments, a relatively fragile thread or ribbon 70 may be used instead of, or in addition to, one or more security labels to indicate a cap 72 may have been removed from a ball bat. The ribbon 70 may be bonded or otherwise attached to the cap 72 and to an inner surface of the barrel 74, as shown in FIG. 7A. Alternatively, one end of the ribbon 70 may be bonded to the cap 72 and the other end may be integrated into the composite barrel layup, or the ribbon 70 may be pulled through a small hole in the barrel 74 and bonded to an outer surface of the barrel 74, as shown in FIG. 7B. In another embodiment, the ribbon may be drawn across the bond interface between the cap 72 and the barrel 74.

The tensile strength of the ribbon 70 should be less than the strength of the bonds or other attachments between the ribbon 70 and the cap 72 and the ribbon 70 and the barrel 74, such that the ribbon 70 will break upon removal of the cap 72 (as opposed to becoming detached from the cap 72 or the barrel 74). The presence of a broken ribbon 70, or the absence of the ribbon 70, provides an indication the cap 72 has been removed and that tampering with the interior of the bat may have occurred. The ribbon 70 optionally may include a holographic image or other security feature described above to make counterfeiting the ribbon 70 more difficult.

Any of the above-described embodiments may be used alone or in combination with one another. For example, a ball bat 10 may include an indicator layer 22 or directly applied graphics on the radially inner surface of the barrel 14, and may further include a transparent or translucent cap 30 including internal observable features, or one or more security labels bonded to the cap and the barrel. The cap 30 may optionally further include an opening 26 covered by a window. Such an opening 26 would preferably provide a large enough field of view for an observer to be able to see past the internal observable features into the interior of the bat 10, thereby allowing the observer to view the indicator layer 22 or directly applied graphics through the opening 26. The cap may also include engraved or etched portions that align with corresponding engraved or etched portions in the barrel 14. Any combination of these and other described features may be included in the ball bat 10.

The ball bats described herein provide an observable indication of whether tampering has occurred with the internal bat structure or the barrel cap. As a result, users of the ball bats should be deterred from shaving or sanding away internal layers of the bats, thus helping to maintain the bats within association performance limits.

While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:
- a handle;
- a barrel connected to, or integral with, the handle;
- a transparent or translucent cap attached to a free end of the barrel;
- a security label, attached to an unexposed surface of the cap and to the barrel such that removal of the cap damages or destroys the security label.

2. The ball bat of claim 1 wherein the security label is bonded to the cap via a transparent or translucent adhesive such that the security label may be viewed through the cap.

3. The ball bat of claim 2 wherein the security label is bonded to the barrel via the same transparent or translucent adhesive.

4. The ball bat of claim 1 wherein the security label includes a holographic image.

5. The ball bat of claim 1 wherein the security label includes a custom image created by a reflective or wavelength-specific ink.

6. The ball bat of claim 1 wherein the security label is cut into an intricate shape.

7. A ball bat, comprising:
- a handle;
- a barrel connected to, or integral with, the handle;
- a transparent or translucent cap attached to a free end of the barrel;
- a security label bonded to an unexposed surface of the cap via a transparent or translucent adhesive such that the security label may be viewed through the cap, and bonded to the barrel such that removal of the cap damages or destroys the security label, wherein the security label includes a holographic image or a custom image created by a reflective or wavelength-specific ink.

8. The ball bat of claim 7 wherein the security label is cut into an intricate shape.

9. A ball bat, comprising:

a handle;

a barrel connected to, or integral with, the handle;

a cap attached to the barrel; and a thread or ribbon attached to an unexposed surface of the cap at a first attachment point and to the barrel at a second attachment point, wherein the tensile strength of the thread or ribbon is less than the attachment strength at the first and second attachment points such that the thread or ribbon breaks if the cap is removed from the barrel.

10. The ball bat of claim 9 wherein the second attachment point is located on an inner surface of the barrel, and wherein the thread or ribbon is bonded to the barrel at the second attachment point.

11. The ball bat of claim 9 wherein the second attachment point is located on an outer surface of the barrel, and wherein the thread or ribbon passes through a hole in the barrel and is bonded to the barrel at the second attachment point.

12. The ball bat of claim 9 wherein the cap is bonded to the barrel along a bond interface.

13. The ball bat of claim 12 wherein the second attachment point is located within the bond interface.

14. The ball bat of claim 9 wherein the thread or ribbon includes a holographic image.

15. The ball bat of claim 9 wherein the cap comprises a transparent or translucent material.

* * * * *